US012116534B2

(12) United States Patent
Respini

(10) Patent No.: US 12,116,534 B2
(45) Date of Patent: Oct. 15, 2024

(54) STABILIZING ASPHALTENE IN CRUDE OIL USING WASTE PLASTIC ANTIFOULANTS

(71) Applicant: Baker Hughes Oilfield Operations LLC, Houston, TX (US)

(72) Inventor: Marco Respini, Casalmorano (IT)

(73) Assignee: Baker Hughes Oilfield Operations LLC

( * ) Notice: Subject to any disclaimer, the term of this patent is extended or adjusted under 35 U.S.C. 154(b) by 0 days.

(21) Appl. No.: 17/583,029

(22) Filed: Jan. 24, 2022

(65) Prior Publication Data

US 2023/0235235 A1 Jul. 27, 2023

(51) Int. Cl.

| | |
|---|---|
| ***C10G 29/22*** | (2006.01) |
| ***C10L 1/16*** | (2006.01) |
| ***C10L 1/198*** | (2006.01) |

(52) U.S. Cl.

CPC ..... *C10G 29/22* (2013.01); *C10L 1/1633* (2013.01); *C10L 1/1983* (2013.01); *C10G 2300/206* (2013.01)

(58) Field of Classification Search

CPC ..... C10G 2300/206

See application file for complete search history.

(56) References Cited

U.S. PATENT DOCUMENTS

| | | | | |
|---|---|---|---|---|
| 3,640,824 | A * | 2/1972 | Bucaram | C09K 8/524 507/221 |
| 4,868,233 | A * | 9/1989 | Moran | C08L 95/00 524/62 |
| 2004/0043906 | A1* | 3/2004 | Heath | C09K 8/536 507/200 |
| 2013/0341241 | A1* | 12/2013 | Respini | C10G 75/00 208/177 |
| 2017/0096606 | A1 | 4/2017 | Pinappu et al. | |
| 2018/0079976 | A1 | 3/2018 | Tort et al. | |
| 2018/0201847 | A1* | 7/2018 | Kohli | C10G 47/22 |
| 2021/0155843 | A1 | 5/2021 | Gul et al. | |
| 2022/0041940 | A1* | 2/2022 | Pradeep | C10G 11/18 |

FOREIGN PATENT DOCUMENTS

| | | | | |
|---|---|---|---|---|
| CN | 101235280 | B * | 6/2010 | |
| JP | 2008133321 | A | 6/2008 | |
| SU | 1745745 | A1 * | 7/1992 | |
| WO | WO-2004044042 | A1 * | 5/2004 | B29B 17/0052 |

OTHER PUBLICATIONS

Machine Translation of WO-2004044042-A1 (Year: 2004).*
Machine Translation of SU1745745 (Year: 1992).*
Machine Translation of CN101235280B (Year: 2010).*
Atta, Ayman M. et al., "Using of modified plastic waste based on poly(ethylene-co-acrylic acid) grafts to solve transportation problem of petroleum crude oil," Journal of Dispersion Science and Technology, 2008, vol. 29, pp. 7-19.
ISR/KR, Written Opinion in PCT/US2023/011425 dated May 15, 2023.

* cited by examiner

*Primary Examiner* — Ellen M McAvoy
*Assistant Examiner* — Ming Cheung Po
(74) *Attorney, Agent, or Firm* — Baker Hughes Company

(57) ABSTRACT

A method for stabilizing asphaltenes in petroleum feedstocks such as crude oil includes adding to the feedstock an effective amount of an additive containing at least one waste plastic. Suitable waste plastics include, but are not necessarily limited to, polyethylene, polyethylene terephthalate, polystyrene, polycarbonate, polyamide, and polyurethane, and combinations thereof. By "stabilizing" is meant keeping the asphaltenes in solution in the petroleum feedstocks.

18 Claims, 5 Drawing Sheets

STABILIZING ASPHALTENE IN CRUDE OIL USING WASTE PLASTIC ANTIFOULANTS

TECHNICAL FIELD

The present invention relates to methods for stabilizing asphaltenes in petroleum feedstocks, and more particularly relates to methods for stabilizing asphaltenes in petroleum feedstocks by keeping them in solution through the addition of an effective amount of an additive that contains waste plastic.

BACKGROUND

Many fluids from subterranean formations, such as petroleum feedstocks, contain a large number of components with a very complex composition. For the purposes herein, a formation fluid is the product from an oil well from the time it is produced until it is refined. Some of the potentially fouling-causing components present in a formation fluid, for example wax and asphaltenes, are liquid under ambient conditions, but may aggregate or deposit under lower temperatures and pressures. Additionally, blending feedstocks of different compositions which are incompatible may also make asphaltenes come out of solution and cause problems; in a non-limiting instance such as when heavy Canadian crude oil is blended with shale oil. Waxes comprise predominantly high molecular weight paraffinic hydrocarbons, i.e., alkanes. Asphaltenes are typically dark brown to black-colored amorphous solids with complex structures and relatively high molecular weight and varying degrees of polarity depending on their origin compared to other crude oil components.

In addition to carbon and hydrogen in the composition, asphaltenes also may contain nitrogen, oxygen and sulfur species, as well as metals including, but not necessarily limited to vanadium, nickel, etc. Typical asphaltenes are known to have different solubilities in the formation fluid itself or in certain solvents like carbon disulfide, but are insoluble in solvents like light paraffins, including but not necessarily limited to pentane, heptane, etc.

For example, asphaltenes are most commonly defined as that soluble class of materials of crude oil, which is insoluble in heptane or pentane, but which is soluble in xylene and toluene. Asphaltenes exist in the form of colloidal dispersions stabilized by other components in the crude oil or other petroleum feedstock, and they may also exist as soluble species. They are the most polar fraction of crude oil, and often will be subjected to compositional and morphological changes and precipitate upon pressure changes, temperature changes, and indirect factors such as resulting from blending with another, incompatible crude oil, or other mechanical or physicochemical processing. Compositional changes include, but are not necessarily limited to, blending with different fluids such as other hydrocarbon mixtures, water, and other liquids that may adversely affect the solubility of asphaltenes in the resulting mixture.

As will be discussed in further detail, asphaltenes in petroleum feedstocks are known to cause issues like sludge, plugging deposits, fouling and corrosion in production, transferring and processing of the petroleum feedstocks, thereby increasing operating and maintenance costs of production. In one non-limiting embodiment, sludge refers to the residual, semi-solid material left or deposited or precipitated from the petroleum feedstocks.

Asphaltene precipitation occurs in pipelines, separators, valves, furnaces, heat exchangers, and other equipment.

Once formed and/or deposited, asphaltenes present numerous problems for crude oil producers. For example, asphaltene deposits can partially or completely plug or block downhole tubulars, well-bores, choke off pipes, pipelines, transfer lines or other conduits, valves and/or safety devices, and interfere with the functioning of separator equipment. These phenomena may result in shutdown, loss of production and risk of explosion or unintended release of hydrocarbons into the environment either on-land or off-shore.

In further detail, when the formation fluid from a subsurface formation, such as crude oil, comes into contact with a pipe, a valve, or other production equipment of a wellbore, or when there is a decrease in temperature, pressure, or change of other conditions, asphaltenes may precipitate or separate out of a well stream or the formation fluid while flowing into and through the wellbore to the wellhead. While any asphaltene separation or precipitation is undesirable in and by itself, it is much worse to allow the asphaltene precipitants to accumulate by sticking to the equipment in the wellbore. Any asphaltene precipitants sticking to the wellbore surfaces may narrow pipes; and clog wellbore perforations, various flow valves, and other well site and downhole locations. This may result in well site equipment failures. It may also slow down, reduce or even totally prevent the flow of formation fluid into the wellbore and/or out of the wellhead.

Similarly, undetected precipitations and accumulations of asphaltenes in a pipeline for transferring crude oil could result in loss of oil flow and/or equipment failure. Crude oil storage facilities could have maintenance or capacity problems if asphaltene precipitations occur. These fluids also carry unstable asphaltenes into the refinery, as well as possibly into finished fuels and products where the asphaltenes cause similar problems for facilities of this nature.

In general, when a petroleum feedstock or a hydrocarbon mixture has formed an additional phase with objectionable or problematic properties, the mixture may be characterized as "unstable" or as "demonstrating instability."

There are large incentives to mitigate fouling in refining. Refinery fouling due to asphaltenes precipitation apart from the mechanisms explained above is often highly related to temperature increase. Typically, temperatures above 180-200° C. can induce asphaltenes phase separation and their consequent precipitation and fouling. Above 400° C., thermal cracking of asphaltenes results in their conversion into less soluble, more fouling thermally cracked asphaltenes, increasing their phase separation and precipitation tendency. There are large costs associated with shutting down production units because of the fouling components within, as well as the cost to clean the units. Further, the asphaltenes may create an insulating effect within the production unit, and may reduce the heat transfer efficiency, and reactivity, and the like. Heat transfer efficiency decrease must be compensated with a higher energy consumption and consequently more emissions, particularly of $CO_2$. In either case, reducing the amount of fouling-causing components would reduce the cost of hydrocarbon fluids and the products derived therefrom. Additional operational problems in refinery and other processing include, but are not necessarily limited to, fouling of heat exchangers and furnaces, increased tube skin temperatures of furnaces, increased unit upsets, increased pollution, loss of through-put, difficulty with desalting, increased load on wastewater plants, increased in air emissions, and reduced flexibility in plant operations, and the like.

Thus, it would be desirable to develop a method and compositions for reducing the amount of fouling-causing components within a petroleum feedstock. Such additive compositions may be called "dispersants" or "antifoulants".

SUMMARY

There is provided, in one form, a method for stabilizing asphaltenes in a petroleum feedstock which method includes adding to the petroleum feedstock containing asphaltenes an effective amount to improve the stability of asphaltenes in the petroleum feedstock at least one additive comprising at least one waste plastic; and stabilizing the asphaltenes in the petroleum feedstock.

Additionally, there is provided a stabilized petroleum feedstock that includes a petroleum feedstock, asphaltenes, and an effective amount of at least one additive to improve the stability of asphaltenes in the petroleum feedstock, where the at least one additive comprises at least one waste plastic.

There is further provided a laboratory testing method based on the application of light scattering flocculation titration with an asphaltene paraffinic precipitant, using heptane or other asphaltenes precipitant, which testing method can be used to evaluate the effectiveness of the waste plastic as a dispersant or flocculant.

DETAILED DESCRIPTION

Figure 1:
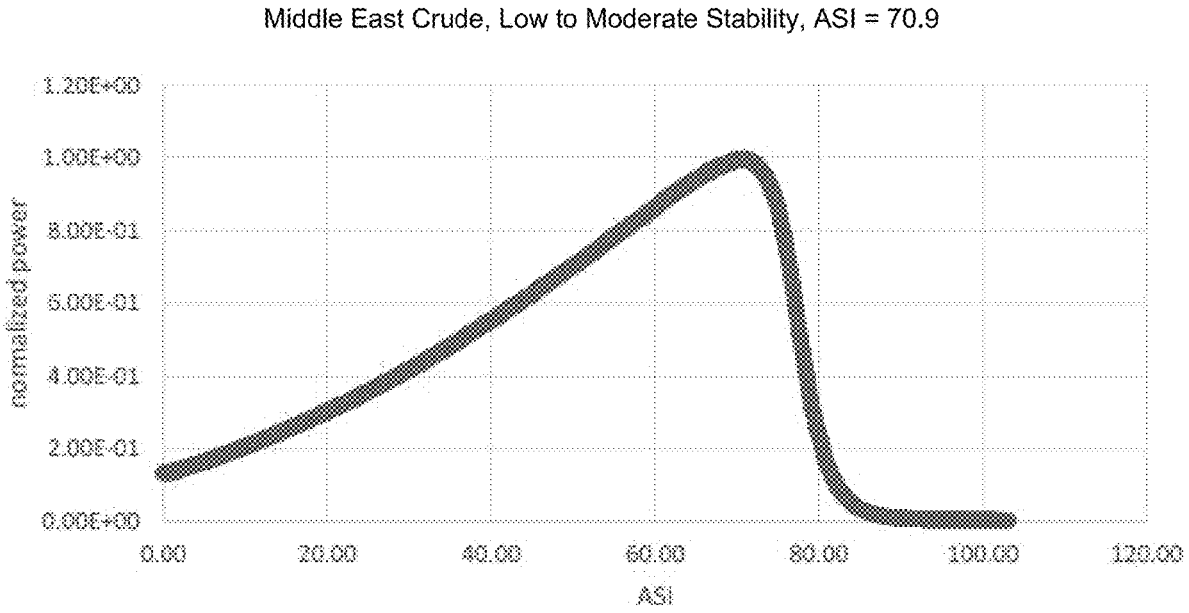
FIG. 1 is a graph of stability measured by Asphaltene Stability Index (ASI) by light scattering in the near infrared for a Middle East crude oil having low to moderate stability, where ASI=70.9 using no dispersant or flocculant.

It has been discovered that waste plastics dissolved in a solvent can stabilize the asphaltenes in petroleum feedstocks by adding effective amounts of a plastics to the petroleum feedstock to act as a dispersant or an antifoulant. This method can reduce fouling and consequent fuel increase costs, as well as reduce $CO_2$ and other emissions from refinery-fired heaters. The waste plastics that were tested can be processed at low percentages in refineries as they are partly thermally cracked to distillates while they produce some residuum and eventually acceptable levels of coke and residual metals from catalysts used in their manufacture. The method can also reduce downtime and costs for cleaning equipment that would be otherwise fouled.

The fouling-causing components may include asphaltenes. Other materials that may cause fouling include, but are not necessarily limited to, solids particles, resins, organic acids, polymers, oxides, sulfides, metals, waxes, and combinations thereof. The methods of stabilizing asphaltenes may or may not stabilize these other materials and/or keep them from fouling as well.

It is typical to have petroleum feedstock blend in a tank that when added to a different petroleum feedstock blend in a different tank induces significant destabilization in the new blend or mixture. This destabilization may be controlled and avoided with proper selection of effective amounts of a biological source oil and/or a chemical additive.

"Inhibit" is defined herein to mean that the waste plastic additive may suppress or reduce the ability of the asphaltenes in the petroleum feedstocks to precipitate, flocculate or agglomerate in a problematic way if there are actually any asphaltenes present within the petroleum feedstocks. Without being limited to any particular explanation or mechanism, it is believed that this is accomplished by the asphaltenes remaining in solution in the petroleum feedstocks. "Prevent" is defined herein to mean entirely preventing any asphaltene precipitation, flocculation or agglomeration, or in other words, complete stability. However, it is not necessary for fouling to be entirely prevented for the methods and compositions discussed herein to be considered effective, although complete prevention and complete stabilization are desirable goals. All that is necessary is for asphaltenes to be more stabilized as compared with an identical petroleum feedstock absent the effective amount of the waste plastic.

The asphaltenes may be stabilized in the petroleum feedstocks by one or more different mechanisms, such as but not limited to a stabilization mechanism, a dispersant mechanism, including solvation/micellization by additives coating asphaltenes aggregates while providing a more oil/hydrocarbon soluble outer layer, generation of repulsive electrical charges on asphaltene aggregates reducing their agglomeration tendency, introduction of steric hindrance by polymeric stabilizing additives, a radical inhibition mechanism, or combinations thereof. Polystyrene has a structure that is not so different from asphaltenes (i.e., "archipelago asphaltenes model" of interacting polycyclic aromatic hydrocarbons (PAHs)), and might treated as a sort of asphaltenic material, which likely directly interacts with asphaltenes by polar/polar interactions of the aromatic rings. Polyethylene terephthalate has both esters (polar groups) and paraffinic short chains and aromatic cores, and thus might be expected to interact with asphaltenes (interaction of asphaltenes polar groups with the ones of Polyethylene terephthalate).

The stabilization mechanism may be performed in a petroleum feedstock at a temperature ranging from about ambient and/or room temperature (defined herein as 22° C. (72° F.) independently to about 1000° C., or alternatively from about 200° C. independently to about 800° C. once the waste plastic additive has been added to the base fluid. The effective amount of the waste plastic additive added to the petroleum for the stabilization effect to occur, can range from about 0.01 to about 5 wt. %; alternatively, from about 0.08 wt. % independently to about 2 wt. %; and in another non-restrictive embodiment from about 0.1 wt. % to about 1 wt. %, based on the petroleum feedstock. "Independently" is defined herein to mean that any lower threshold may be used together with any upper threshold to give a suitable alternative range. In a non-limiting example, another suitable dosage range would be from about 0.08 wt. % to about 1 wt. %. An effective amount is defined herein as an amount added that inhibits or prevents the asphaltenes from agglomerating, precipitating or flocculating together.

The petroleum feedstocks may include, but are not necessarily be limited to, crude oils, heavy oils, coker feedstocks, visbreaker feedstocks, vacuum tower bottoms, fuel oils, diesel oils, bunker fuel oils (including, but not limited to, #6 oils), and the like and mixtures thereof. Petroleum feedstocks suitable herein include variations of those listed, including, but not necessarily limited to, "heavy crude oil", "heavy oil", "heavy fuel oil" and the like.

Temperature can be a factor in the method described herein only for resids (residual oil products that remain after petroleum has been distilled) or very viscous feeds; in general, the temperature of the petroleum feedstock is not expected to be a factor.

Suitable waste plastics can include, but are not necessarily limited to, polyethylene (PE), polyethylene terephthalate (PETE), polystyrene (PS), polycarbonate (PC), polyamide (Nylon class), and polyurethane, and combinations thereof. By "waste plastics" it is to be understood that the plastics were used to make some other article that has outlived its usefulness and is considered waste, in a non-limiting example, plastic bottles or PETE packaging. In one non-limiting embodiment the only dispersant or antifoulant is one or more waste plastic.

A first step is to reduce the size of the plastic, in a non-limiting example by grinding the bottles or other articles to a suitable size, such as into chips a few millimeters in size. Then the particles are dissolved in a suitable solvent. In one non-limiting embodiment, a solvent can include, but is not necessarily limited to, refinery gasoil, a hydrocarbon refinery stream, gasoline, fluid catalytic coking heavy cycle oil, light cycle oil, delayed coker heavy gasoil, xylene, benzene, and combinations thereof. In one non-limiting embodiment, the waste plastic dispersed in solvent is likely 'captured', suspended, or dispersed by London dispersion forces, also loosely known as van der Waals forces.

Waste plastic can be converted at high percentages by thermal "cracking" that is typical of hydrocarbon processing above 400° C., and blended into hydrocarbon distillates which can be used as fuel, particularly when integrated with gasoline or diesel, or after different processing sent to a petrochemical steam cracker for the production of more monomers.

In another non-limiting embodiment, the method for stabilizing asphaltenes in a petroleum feedstock involves a number of steps, including, but not necessarily limited to:

1. evaluating the petroleum feedstock or blend of feedstocks (petroleum derived refinery streams) for asphaltene stability;
2. when the petroleum feedstock exhibits asphaltene instability, introducing the additive containing waste plastics into the petroleum feedstock; and
3. evaluating the additive for asphaltene stability of the petroleum feedstock.

Evaluating a petroleum feedstock for asphaltene stability may be performed using any of a number of known and proprietary evaluation and analytical methods, including, but not necessarily limited to, ASTM D7060 (Shell P-value method), ASTM-D7157 (S-value), ASTM D4312 (Toluene Equivalents Test), ASTM D2781 (the Spot Test), and the Baker Hughes Field ASI Test (ASIt). ASIt is a laboratory testing method based on the application of light scattering flocculation titration with an asphaltene paraffin precipitant, typically heptane or other suitable precipitant. The determination of stability by light scattering is very accurate and reliable, and ASIt is the preferred test method herein.

It will be appreciated that, as previously noted, petroleum feedstocks, such as crude oils, may vary widely in composition from one to another, and the waste plastic additive, and its proportion that is optimal for one petroleum feedstock, may not be the type or amount of waste plastic additive optimal for a different petroleum feedstock.

Advantages of the method described herein over conventional, synthetic fouling control additives include, but are not limited to, the re-use of a waste stream, and use of a low-cost raw material.

The invention will now be described with respect to particular embodiments which are not intended to limit the invention in any way, but which are simply to further highlight or illustrate the invention. All percentages (%) are weight percentages unless otherwise noted.

EXAMPLES 1-5

A Middle East crude oil was used in all Examples, alone and then with the indicated additives. An Asphaltene Stability Index (ASI) for each was measured using a proprietary evaluation technique.

In Example 1, the ASI of the Middle East crude, which had low to moderate stability on its own, was measured with no additive. The results are presented in FIG. 1. ASI=70.9, which is shown by the peak of the curve. This result may be considered a baseline or a "blank".

Figure 2:
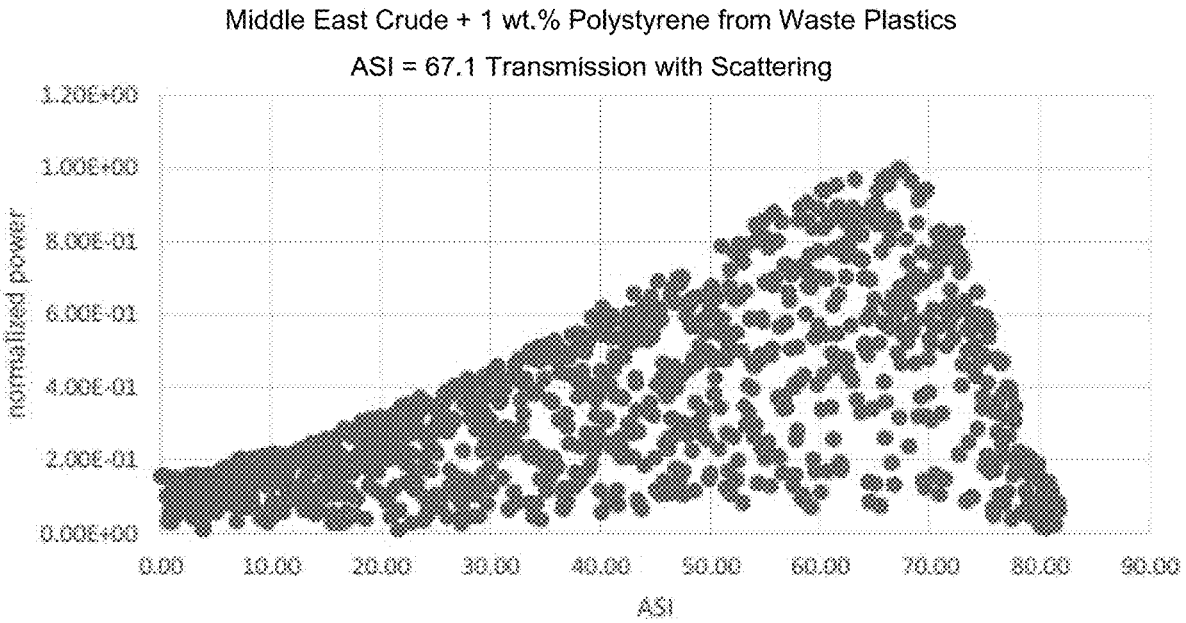
FIG. 2 is a graph of stability measured by ASI by light scattering for the Middle East crude of FIG. 1 containing 1 wt. % polystyrene dispersant/flocculant from waste plastics where ASI=67.1.

In Example 2, 1 wt. % polystyrene dispersant/flocculant from waste plastics was added to the Middle East crude. FIG. 2 is a graph of stability measured by ASI by light scattering, where ASI=67.1. This transmission indicated scattering, which was likely aggregation of the polystyrene with asphaltenes before the precipitation in the ASIt. In this case, the polystyrene was destabilizing, and stability decreased (67.1 being less than the 70.9 baseline) and the amount of precipitate increased. Thus, while polystyrene was not suitable for this crude, polystyrene may have positive interactions with other crudes and/or at different dosages. For example, waste polystyrene may be suitable lighter crudes with less total asphaltenes and/or crudes having asphaltenes that are more soluble.

Figure 3:
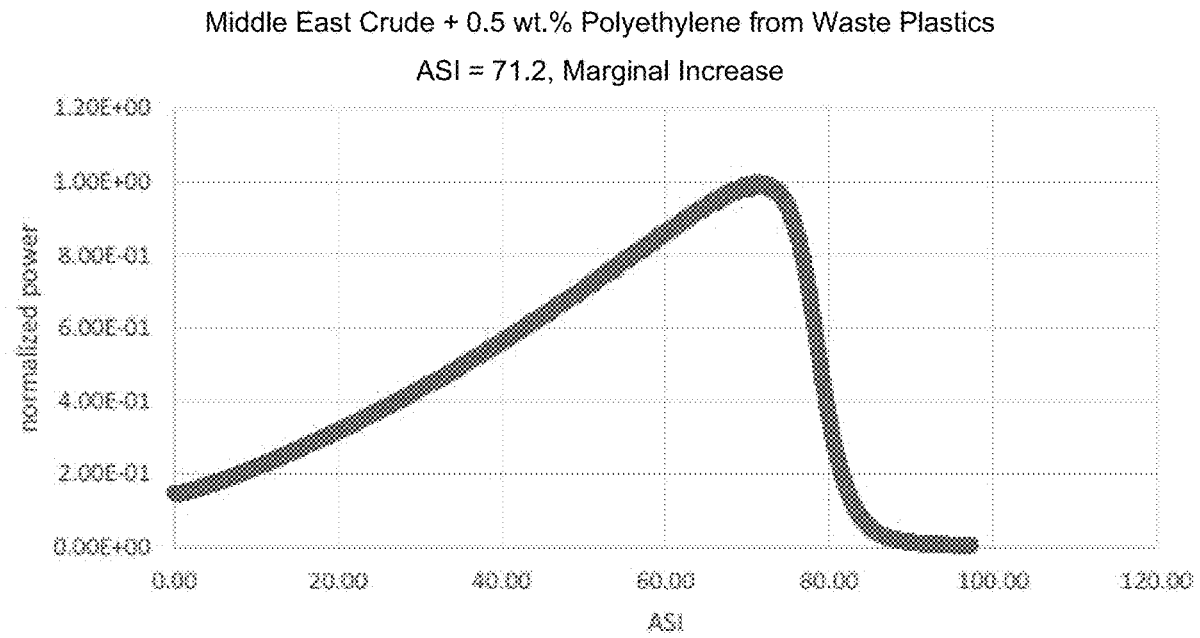
FIG. 3 is a graph of stability measured by ASI by light scattering for the Middle East crude of FIG. 1 containing 0.5 wt. % polyethylene dispersant/flocculant from waste plastics where ASI=71.2 indicating a marginal increase in stability over the FIG. 1 result.

In Example 3, 0.5 wt. % polyethylene dispersant/flocculant from waste plastics was introduced into the Middle East crude of Example 1. FIG. 3 is a graph of stability measured by ASI by light scattering where ASI=71.2 indicating a marginal increase in stability over the Example 1 ASI.

Figure 4:
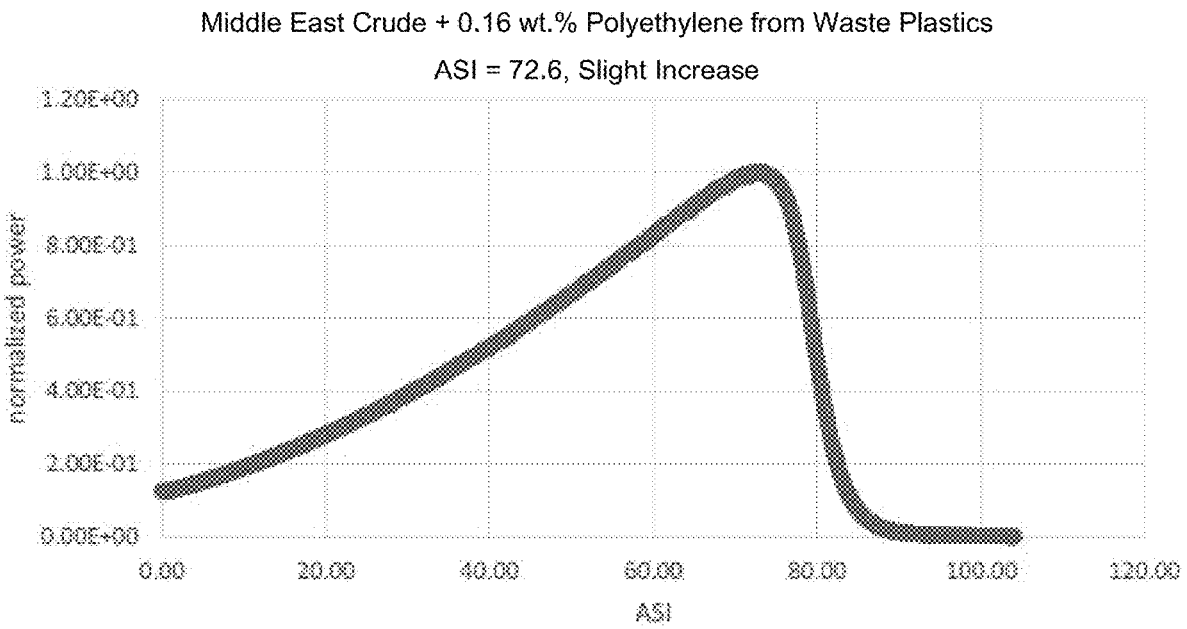
FIG. 4 is a graph of stability measured by ASI by light scattering for the Middle East crude of FIG. 1 containing 0.16 wt. % polyethylene dispersant/flocculant from waste plastics where ASI=72.6 indicating a slight increase in stability over the FIG. 1 result.

In Example 4, 0.16 wt. % polyethylene dispersant/flocculant from waste plastics was added to the Middle East crude of Example 1. FIG. 4 is a graph of stability measured by ASI by light scattering for containing where ASI=72.6 indicating a slight increase in stability over the Example 1 ASI.

Figure 5:
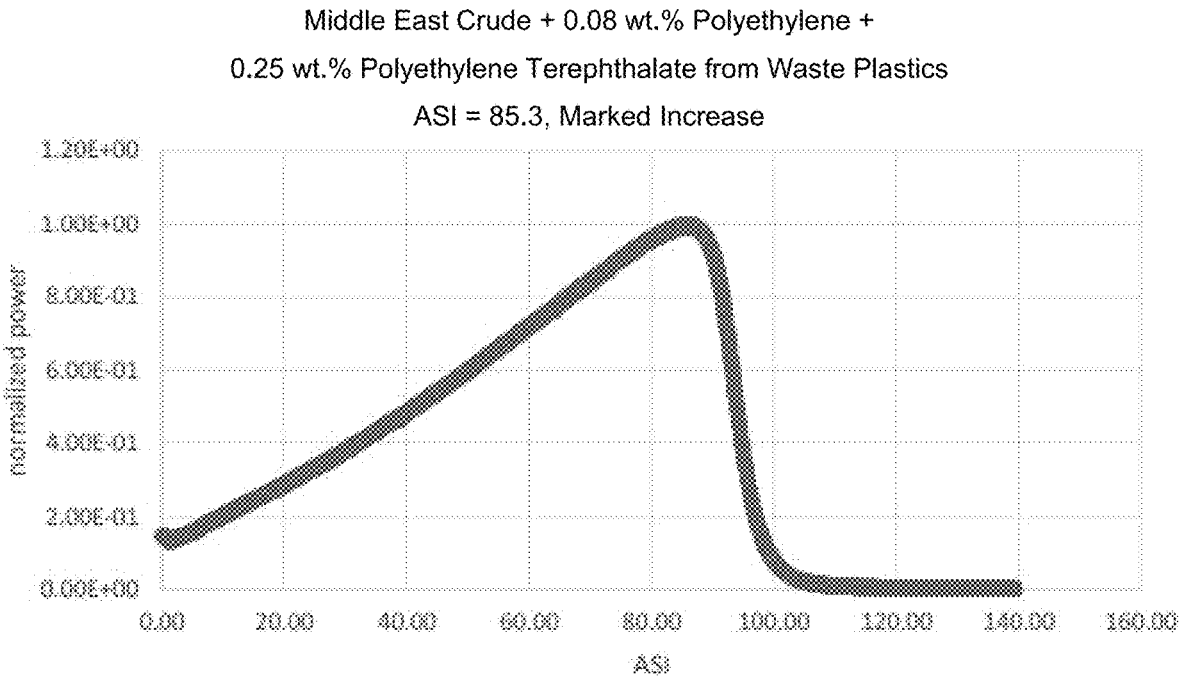
FIG. 5 is a graph of stability measured by ASI by light scattering for the Middle East crude of FIG. 1 containing 0.08 wt. % polyethylene dispersant/flocculant and 0.25 wt. % polyethylene terephthalate from waste plastics where ASI=85.3 indicating a marked increase in stability over the FIG. 1 result.

In Example 5, a combination of 0.08 wt. % polyethylene and 0.25 wt. % polyethylene terephthalate, both from waste plastics, were added as a dispersant/flocculant to the Middle East crude of Example 1. FIG. 5 is a graph of stability measured by ASI by light scattering for containing where ASI=85.3 indicating a marked increase in stability; the best of the Examples over the Example 1 ASI.

The Examples thus demonstrate how selected waste plastics dissolved in a solvent can function as antifoulants stabilizing asphaltenes in petroleum feedstocks such as crude oil. Laboratory dose rates are typically higher than the ones needed in field applications by a factor of 10 or more.

Therefore, the diose rates in field are likely lower than the ones used in laboratory. While waste polystyrene had a negative impact, further research may be done at different dosages and/or with different crudes; it may have a positive effect on some different crudes depending on the asphaltene chemistry in those crudes.

The waste plastics are easily recovered from selective use of plastic bottles, plastic packaging, and other forms. They can be easily introduced into refining processes at the indicated dosage levels. Selection of the plastic used may be performed in several ways, for example, by the use of Near Infrared Analyzers since the NIR spectra correlate with plastic blend composition The method herein also discloses an effective test method based on the application of near infrared turbidimetry and precipitation of asphaltenes by a paraffinic non-solvent.

In the foregoing specification, the invention has been described with reference to specific embodiments thereof, and has been described as effective in providing methods and compositions for stabilizing asphaltenes in petroleum feedstocks such as crude oils. However, it will be evident that various modifications and changes can be made thereto without departing from the broader scope of the invention. Accordingly, the specification is to be regarded in an illustrative rather than a restrictive sense. For example, specific petroleum feedstocks, waste plastic additives, solvents, proportions, treatment conditions, and other components and procedures falling within the claimed parameters, but not specifically identified or tried in a particular method or composition, are expected to be within the scope of this invention.

The present invention may suitably comprise, consist or consist essentially of the elements disclosed and may be practiced in the absence of an element not disclosed. For instance, there may be provided a method for stabilizing asphaltenes in a petroleum feedstock comprising, consisting essentially of, or consisting of, adding to the petroleum feedstock containing asphaltenes an effective amount to improve the stability of asphaltenes in the petroleum feedstock at least one additive comprising at least one waste plastic, and stabilizing the asphaltenes in the petroleum feedstock.

Alternatively, there may be provided a stabilized petroleum feedstock that comprises, consists essentially of, or consists of a petroleum feedstock, asphaltenes, and an effective amount of at least one additive to improve the stability of asphaltenes in the petroleum feedstock, where the at least one additive comprises at least one waste plastic.

In another non-restrictive version, the only dispersant or antifoulant in the additive is one or more waste plastic as defined herein.

The words "comprising" and "comprises" as used throughout, are to be interpreted to mean "including but not limited to" and "includes but not limited to", respectively.

As used herein, the singular forms "a," "an," and "the" are intended to include the plural forms as well, unless the context clearly indicates otherwise.

As used herein, the term "about" in reference to a given parameter is inclusive of the stated value and has the meaning dictated by the context (e.g., it includes the degree of error associated with measurement of the given parameter).

As used herein, the term "and/or" includes any and all combinations of one or more of the associated listed items.

What is claimed is:

1. A method for stabilizing asphaltenes in a petroleum feedstock comprising:

evaluating the stability of asphaltenes in the petroleum feedstock;

obtaining at least one waste plastic from plastic bottles or plastic packaging;

reducing the size of the at least one waste plastic into chips;

preparing at least one additive comprising the at least one waste plastic, wherein the step of preparing the at least one additive further comprises the step of dissolving the chips in a solvent; and adding to the petroleum feedstock an effective amount of up to about 1 wt % of the at least one additive to improve the stability of asphaltenes in the petroleum feedstock.

2. The method of claim 1 where the petroleum feedstock is selected from the group consisting of crude oils, heavy oils, coker feedstocks, visbreaker feedstocks, vacuum tower bottoms, fuel oils, diesel oils, bunker fuel oils, and mixtures thereof.

3. The method of claim 1 where the at least one waste plastic is selected from the group of waste plastics consisting of polyethylene, polyethylene terephthalate, polystyrene, polycarbonate, polyamide, and polyurethane, and combinations thereof.

4. The method of claim 1 where the at least one additive comprises at least one waste plastic selected from the group of waste plastics consisting of polyethylene, polyethylene terephthalate, and combinations thereof.

5. The method of claim 1 where the solvent is selected from the group consisting of refinery gasoil, a hydrocarbon refinery stream, gasoline, fluid catalytic coking heavy cycle oil, light cycle oil, delayed coker heavy gasoil, xylene, benzene, and combinations thereof.

6. The method of claim 1 where the effective amount of waste plastic in the petroleum feedstock ranges from about 0.01 wt. % to about 1 wt. %.

7. The method of claim 1 where the effective amount of waste plastic in the petroleum feedstock ranges from about 0.01 wt. % to about 0.5 wt. % and where the petroleum feedstock is crude oil.

8. The method of claim 1 where the effective amount of waste plastic in the petroleum feedstock ranges from about 0.01 wt. % to 0.33 wt. %.

9. A method for stabilizing asphaltenes in a petroleum feedstock comprising:

evaluating the stability of asphaltenes in the petroleum feedstock;

obtaining at least one waste plastic from plastic bottles or plastic packaging;

reducing the size of the at least one waste plastic into chips;

preparing at least one additive comprising the at least one waste plastic, wherein the step of preparing the at least one additive further comprises the step of dissolving the chips in a solvent; and adding to the petroleum feedstock an effective amount of up to about 0.5 wt % at least one additive to improve the stability of asphaltenes in the petroleum feedstock;

where the petroleum feedstock is selected from the group consisting of crude oils, heavy oils, coker feedstocks, visbreaker feedstocks, vacuum tower bottoms, fuel oils, diesel oils, bunker fuel oils, and mixtures thereof; and where the at least one waste plastic is selected from the group of waste plastics consisting of polyethylene, polyethylene terephthalate, polystyrene, polycarbonate, polyamide, and polyurethane, and combinations thereof.

10. The method of claim 9 where the solvent is selected from the group consisting of refinery gasoil, a hydrocarbon refinery stream, gasoline, fluid catalytic coking heavy cycle oil, light cycle oil, delayed coker heavy gasoil, xylene, benzene, and combinations thereof.

11. The method of claim 9 where the effective amount of waste plastic in the petroleum feedstock ranges from about 0.01 wt. % to about 0.5 wt. %.

12. The method of claim 9 where the effective amount of waste plastic in the petroleum feedstock ranges from about 0.02 wt. % to 0.33 wt. %.

13. A stabilized petroleum feedstock comprising:

a petroleum feedstock having asphaltenes and a corresponding baseline asphaltene stability index; and an effective amount of at least one additive of up to about 1 wt. % based on the petroleum feedstock to improve the stability of asphaltenes in the petroleum feedstock, where the at least one additive comprises at least one waste plastic selected from polyethylene terephthalate, polystyrene, polycarbonate, polyamide, and polyurethane, wherein the effective amount of the least one additive increases the baseline asphaltene stability index of the petroleum feedstock, and wherein the additive comprises the waste plastics dissolved in a solvent selected from the group consisting of refinery gasoil, fluid catalytic coking heavy cycle oil, light cycle oil, delayed coker heavy gasoil, xylene, benzene, and combinations thereof.

14. The stabilized petroleum feedstock of claim 13 where the petroleum feedstock is selected from the group consisting of crude oils, heavy oils, coker feedstocks, visbreaker feedstocks, vacuum tower bottoms, fuel oils, diesel oils, bunker fuel oils, and mixtures thereof.

15. The stabilized petroleum feedstock of claim 13 where the at least one waste plastic is polyethylene terephthalate.

16. The stabilized petroleum feedstock of claim 13 where the effective amount of waste plastic in the petroleum feedstock ranges from about 0.01 wt. % to about 1 wt. %.

17. The stabilized petroleum feedstock of claim 13 where the effective amount of waste plastic in the petroleum feedstock ranges from about 0.01 wt. % to about 0.5 wt. % and where the petroleum feedstock is crude oil.

18. The stabilized petroleum feedstock of claim 13 where the effective amount of waste plastic in the petroleum feedstock ranges from about 0.01 wt. % to 0.33 wt. %.

* * * * *